US006553882B1

(12) United States Patent
Daley, Jr. et al.

(10) Patent No.: US 6,553,882 B1
(45) Date of Patent: Apr. 29, 2003

(54) PENCIL SHARPENER WITH INTEGRAL RECEPTACLE

(75) Inventors: Phillip Bruce Daley, Jr., Statesville, NC (US); Peter Bressler, Philadelphia, PA (US); Peter Byar, Willingboro, NJ (US); John Coleman, Philadelphia, PA (US); Leslie Juhng, Philadelphia, PA (US); Mathieu Turpault, Devon, PA (US)

(73) Assignee: Hunt Holdings, Inc., Wilmington, DE (US)

( * ) Notice: Subject to any disclaimer, the term of this patent is extended or adjusted under 35 U.S.C. 154(b) by 0 days.

(21) Appl. No.: 09/543,399

(22) Filed: Apr. 5, 2000

(51) Int. Cl.[7] ..... B43L 23/02

(52) U.S. Cl. ..... 83/453; 83/454; 83/124

(58) Field of Search ..... 30/457, 456, 453, 30/451, 458, 454, 452, 122, 455, 462, 124, 125; 144/28.11, 28.3, 28.6, 28–28.4, 28.72, 28.71; 220/780, 833; 83/167, 453, 454, 124

(56) References Cited

U.S. PATENT DOCUMENTS

| | | | | | |
|---|---|---|---|---|---|
| 947,186 | A | * | 1/1910 | Neuman | 30/456 |
| 1,263,738 | A | * | 4/1918 | Boye | 30/456 |
| 1,285,528 | A | * | 11/1918 | Mobius | 30/454 |
| 1,789,248 | A | * | 1/1931 | Mobius | 30/454 |
| 2,615,426 | A | * | 10/1952 | Fryer | 30/456 |
| 2,718,980 | A | * | 9/1955 | Strom | 220/60 |
| 3,134,364 | A | * | 5/1964 | Chelazzi | 30/454 |
| 3,134,365 | A | * | 5/1964 | Hori | 144/28.11 |
| 3,805,658 | A | * | 4/1974 | Scott et al. | 83/545 |
| 3,965,949 | A | | 6/1976 | Aston et al. | 144/28.71 |
| 4,054,164 | A | | 10/1977 | Kose et al. | 144/28.7 |
| 4,070,941 | A | * | 1/1978 | Lorenz | 83/478 |
| 4,630,794 | A | * | 12/1986 | Ross | 248/309.1 |
| 4,815,507 | A | * | 3/1989 | Orourke | 144/28.5 |
| 4,966,208 | A | | 10/1990 | Uang et al. | 144/28.72 |
| 5,002,182 | A | * | 3/1991 | McGinnis | 206/214 |
| 5,121,834 | A | * | 6/1992 | Tissembaum | 206/38.1 |
| 5,379,817 | A | * | 1/1995 | O'Neil et al. | 30/457 |
| 5,755,352 | A | * | 5/1998 | Wojcik et al. | 220/339 |
| 5,875,555 | A | * | 3/1999 | Andrisin, III et al. | 30/452 |
| 5,938,026 | A | * | 8/1999 | Thorn | 206/362 |
| 5,987,759 | A | | 11/1999 | Nita | 30/454 |
| 5,988,391 | A | * | 11/1999 | Tsubono | 206/701 |

* cited by examiner

*Primary Examiner*—Kenneth E. Peterson
*Assistant Examiner*—Omar Flores-Sánchez
(74) *Attorney, Agent, or Firm*—Synnestvedt & Lechner LLP

(57) ABSTRACT

A housing having an integral receptacle which is particularly useful for pencil sharpeners. The receptacle is attached to the body so as to be pivotable between a closed position, for closing a cavity of the housing, and an open position, for exposing the cavity. This is useful, for example, for emptying pencil shavings in a pencil sharpener.

Attachment of the receptacle to the housing minimizes accidental opening of the receptacle and spillage of shavings. In the open position, the receptacle also serves as a spout for controlled disposal of shavings.

In the preferred embodiment, the housing and receptacle have a mating rib and groove on opposing sides of the cavity which interfit when the receptacle is in the closed position to form a seal trap shavings within the cavity. Additionally, the receptacle is provided with a lower surface and rearward edge positioned to form a seal with the housing when the cover is in the closed and open positions, respectively. The receptacle may be provided with an interlock trigger for engaging and disengaging an interlock switch in the housing to prevent operation of the cutting assembly of a pencil sharpener when the receptacle is in an open position.

20 Claims, 5 Drawing Sheets

FIG. 7A
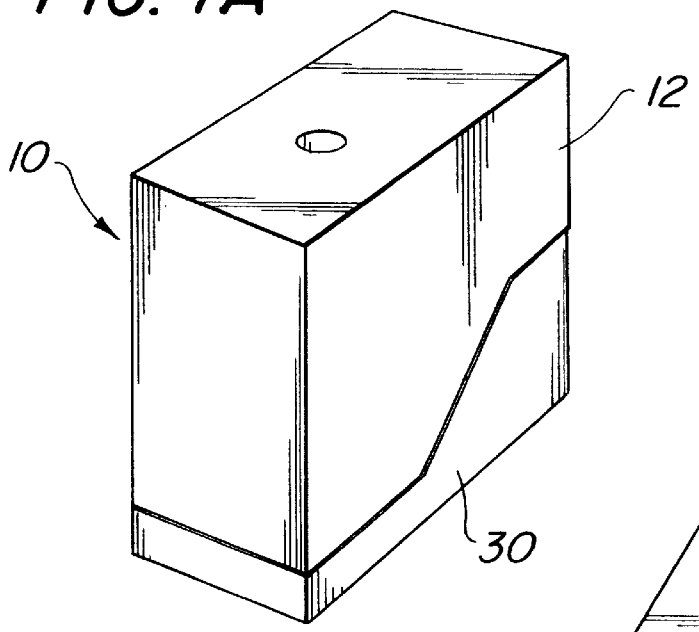
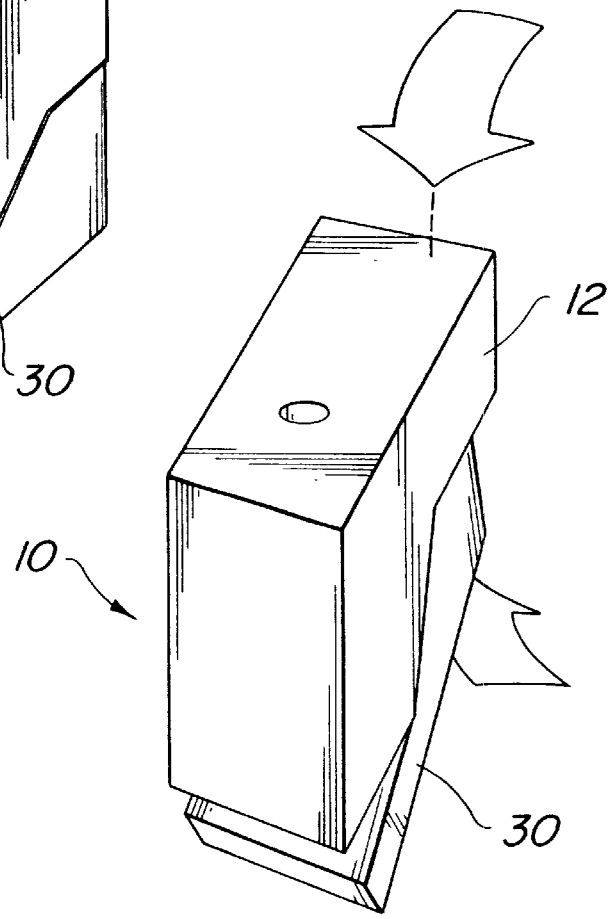
FIG. 7B
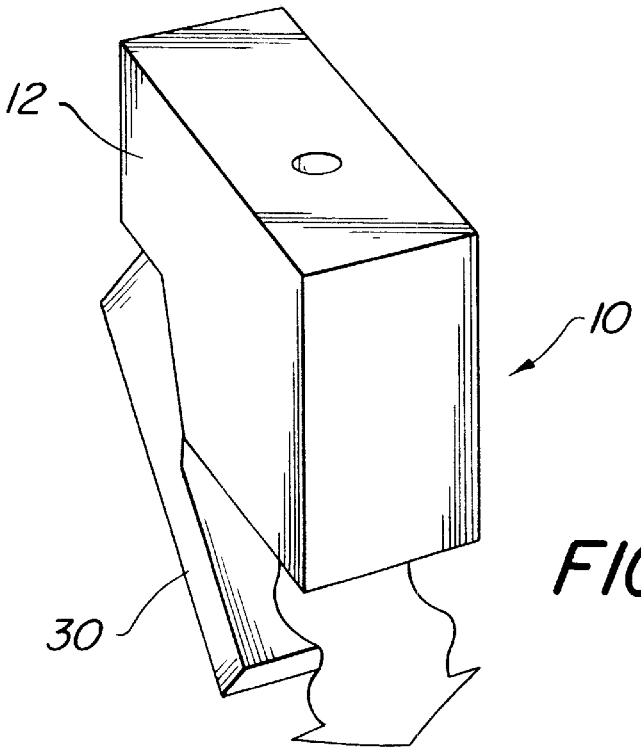
FIG. 7C

FIG. 8A
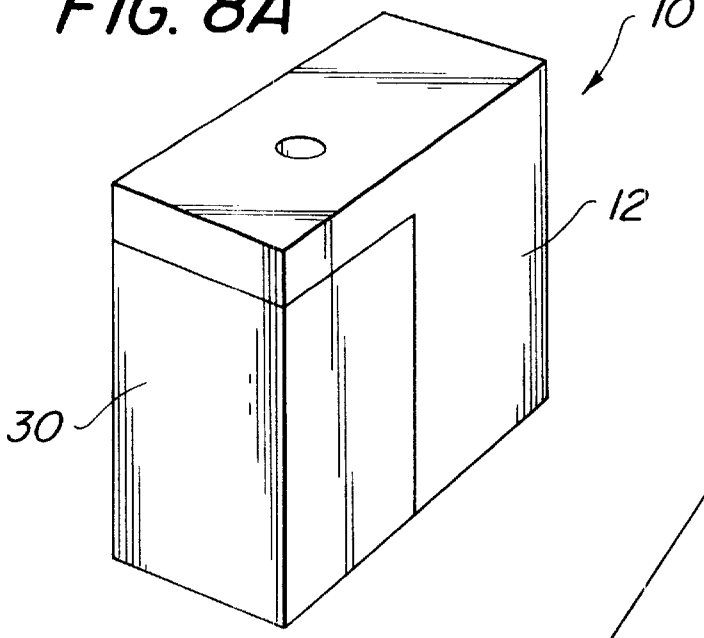
FIG. 8B
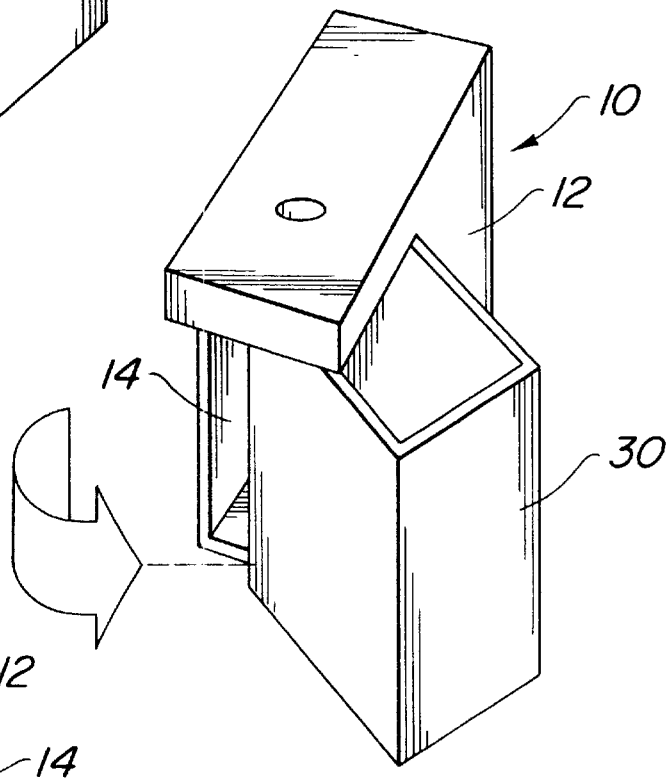
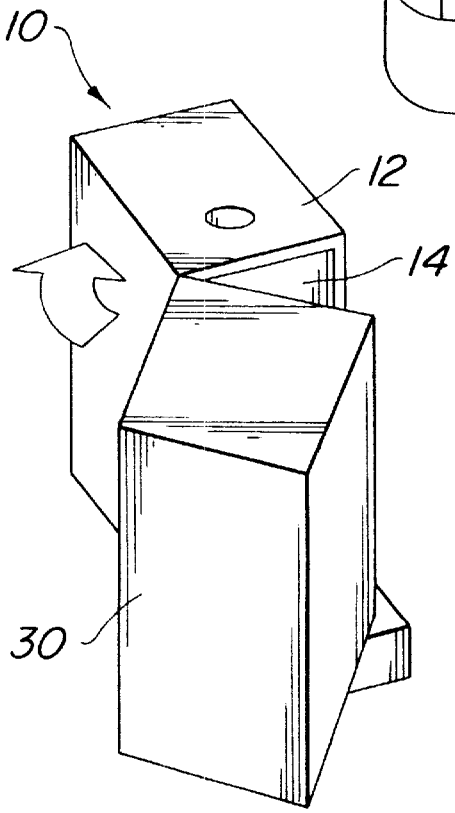
FIG. 8C

PENCIL SHARPENER WITH INTEGRAL RECEPTACLE

FIELD OF THE INVENTION

This invention relates to office products and, more particularly, to pencil sharpeners for sharpening wood-encased ("wood case") pencils.

BACKGROUND OF THE INVENTION

Manually operated pencil sharpeners have long been known. Electrically powered, either corded or cordless (battery powered), pencil sharpeners are now well known. Such pencil sharpeners have a shell or housing having a cavity in which a sharpening assembly is mounted. Many different sharpening assemblies are well-known in the art.

The sharpening assembly cuts the wood to expose and sharpen the lead or graphite (collectively, "lead") encased thereby. The sharpening process creates shavings and dust (collectively "shavings") which are typically trapped within the housing. In one prior art configuration, a removable faceplate is provided allowing access to shavings trapped in a cavity of the housing. In a sense, the cavity and faceplate cooperate to form a receptacle for the shavings. This configuration is common for battery-powered pencil sharpeners. In another prior art configuration, a removable cup and/or drawer fits into the housing and/or cavity for catching and trapping the shavings.

Periodically, the shavings must be discarded. The faceplate, cup, drawer, etc. (collectively "receptacle") is removable from the pencil sharpener for this purpose. In a cup or drawer arrangement, spillage of the shavings is likely when the cup or drawer is removed due to overfilling of the cup or drawer with shavings. Additionally, once removed from the pencil sharpener, the cup or drawer is unstable and shavings are easily spilled. In faceplate arrangements, the shavings are particularly difficult to control and spillage frequently occurs with any amount of shavings.

In some of these arrangements, the receptacle and housing are provided with retention means to provide for snap engagement of the receptacle with the housing to positively position and retain the receptacle. However, such an arrangement causes sudden snap-disengagement of the receptacle from the housing that often results in spillage of shavings.

Additionally, since there are numerous different pencil sharpener configurations, a user's unfamiliarity with a certain pencil sharpener contributes to the likelihood of shavings spillage. Spilled shavings are likely to cause stains that are difficult to clean.

It is therefore desirable to have a pencil sharpener which includes a shavings receptacle that enables a controlled disposal of shavings with minimal spillage.

SUMMARY OF THE INVENTION

The present invention provides a housing having an integral receptacle which is particularly useful for pencil sharpeners. The receptacle is pivotable between a closed position, for closing a cavity of the housing, and an open position, for exposing the cavity during emptying of pencil shavings. The receptacle remains integrally attached to the housing during emptying of pencil shavings. The attachment of the receptacle to the housing enhances stability and control as compared to prior art configurations and minimizes mishandling and accidental opening of the receptacle and any resulting spillage of shavings. In the preferred embodiment, gravity ensures secure closure of the receptacle during normal use when the pencil sharpener is upright on a desk, table, etc. In the open position, the receptacle also serves as a spout for controlled disposal of shavings.

In the preferred embodiment, the housing and receptacle have a mating rib and groove on opposing sides of the cavity which interfit when the receptacle is in the closed position to form a seal for trapping shavings within the cavity and receptacle. Additionally, the receptacle is provided with a lower surface and rearward edge positioned to form a seal with the housing and contain shavings when the receptacle is in the closed and open positions, respectively.

In a highly preferred embodiment, the receptacle includes an interlock trigger. The interlock trigger has an outwardly extending protrusion for engaging an interlock switch mounted in the cavity of the housing when the receptacle is in the closed position. The interlock switch is configured to engage the protrusion only when the receptacle is in the closed position. The interlock switch is configured to permit operation of the cutting assembly of the pencil sharpener only when the switch is engaged by the protrusion. This prevents injuries to the user resulting from contact with an operating assembly.

DESCRIPTION OF THE DRAWINGS

FIGS. 7*a*–7*c* are perspective views of another alternate embodiment in accordance with the present invention.

FIGS. 8*a*–8*c* are perspective views of additional alternate embodiments in accordance with the present invention.

DETAILED DESCRIPTION

In the past, pencil sharpeners have had various receptacles which had to be removed from the housing to empty pencil shavings. Such configurations are inherently unstable and prone to spillage of shavings.

The present invention provides a housing having an integral receptacle that remains attached to the housing during normal operation and emptying of shavings from the pencil sharpener. The integral receptacle is more stable and substantially reduces the likelihood of shavings spillage. In one embodiment, the receptacle may be used as a spout for the controlled disposal of shavings.

Figure 1:
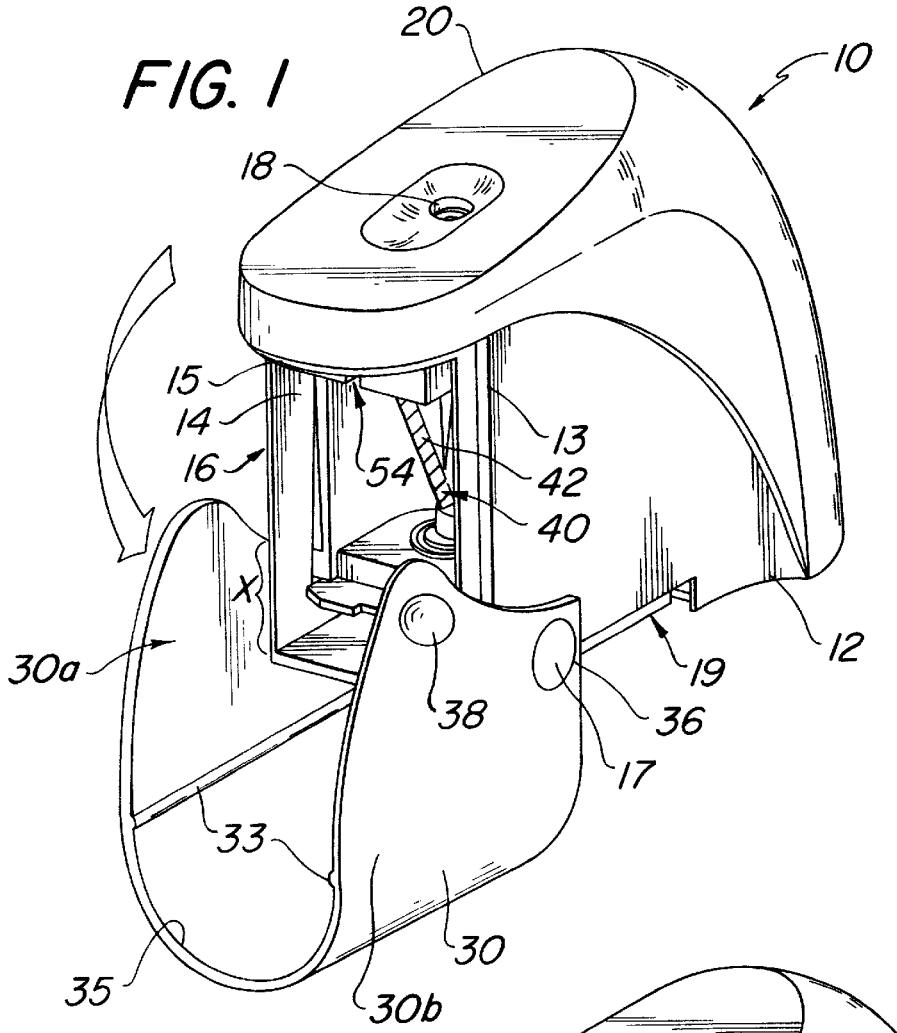
FIG. 1 is a perspective view of a pencil sharpener in accordance with one embodiment of the present invention showing the hinged receptacle in an open position.

The preferred embodiment of the present invention will now be discussed with reference to FIGS. 1–6. FIG. 1 shows a pencil sharpener 10 having a housing 12 to which a receptacle 30 is hingedly attached, as discussed in further detail below. The housing 12 has a cavity 14 and an open end 16, and defines a pencil-receiving opening 18 on its top 20.

Figure 2:
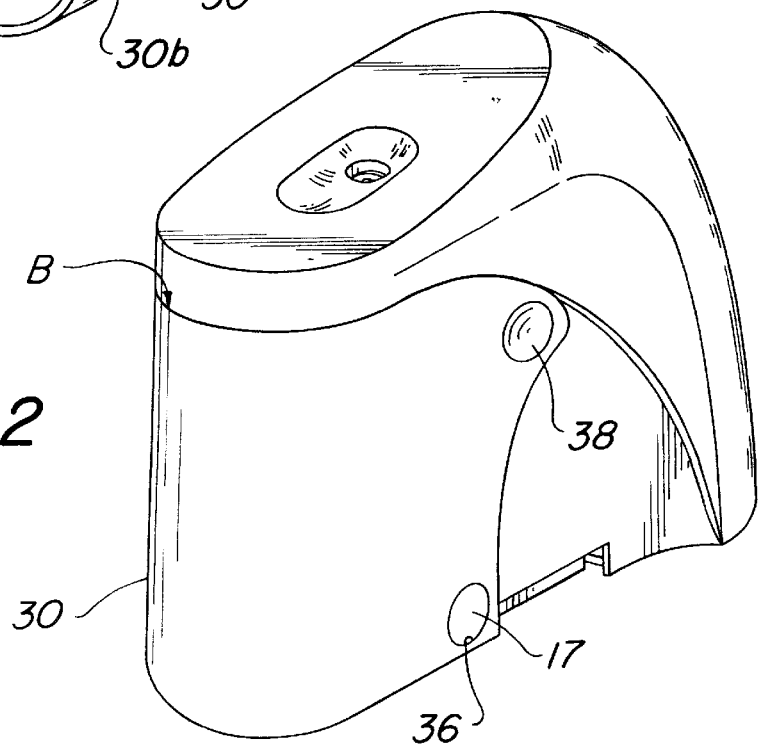
FIG. 2 is a perspective view of the pencil sharpener of FIG. 1 showing the hinged receptacle in a closed position.

A pencil sharpening assembly 40 is mounted within the cavity 14 of the housing 12 in a position to engage and sharpen a pencil inserted into the pencil-receiving opening 18. Shavings produced by the blade 42 of the sharpening assembly 40 collect in the cavity 14. The shavings are retained in the cavity 14 and/or the receptacle 30, when the receptacle 30 is in the closed position, as shown in FIG. 2.

Figure 3:
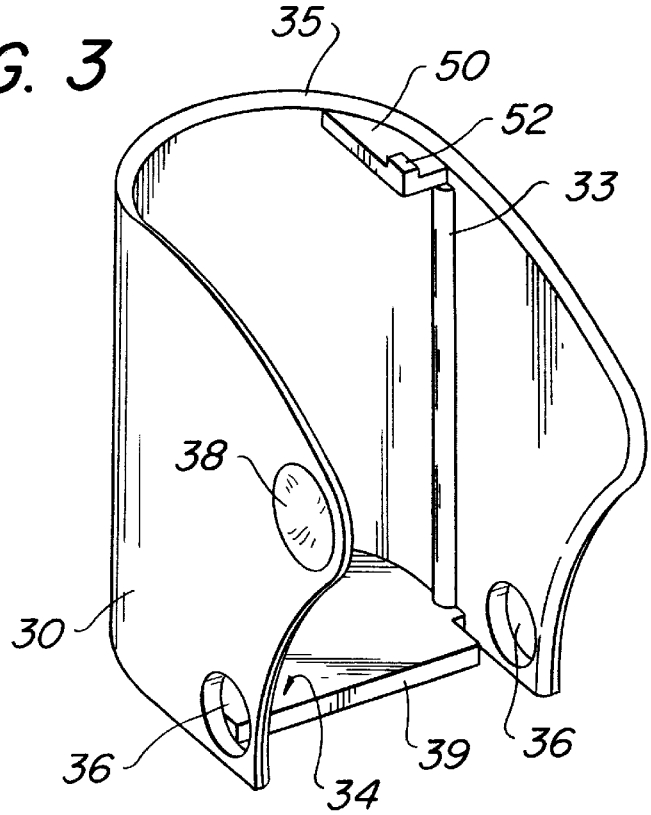
FIG. 3 is a perspective view of a receptacle in accordance with an alternate embodiment of the present invention, shown detached from the housing.
Figure 4:
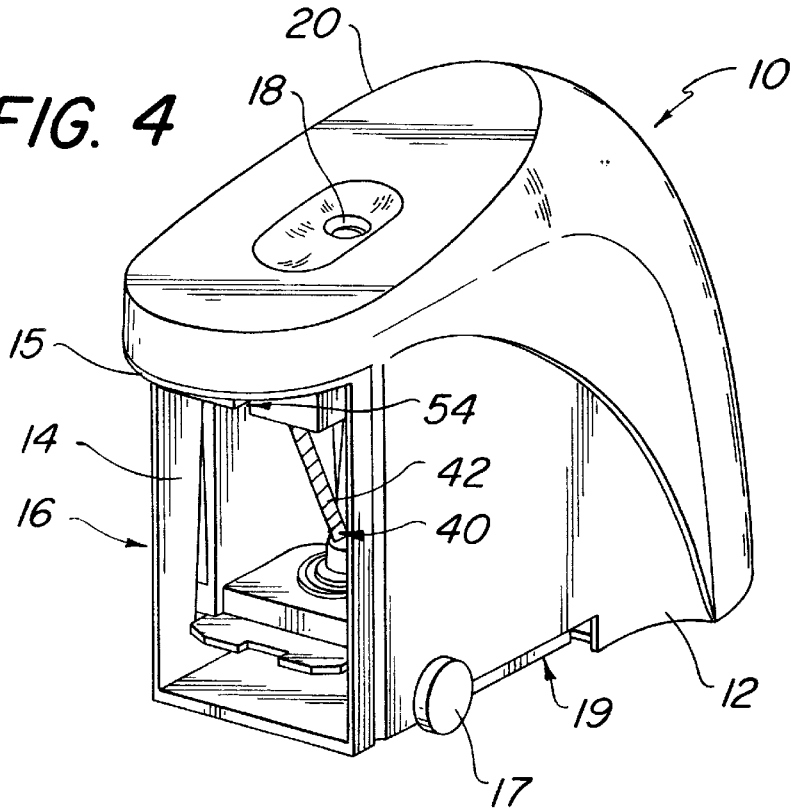
FIG. 4 is a perspective view of the housing of the pencil sharpener of FIGS. 1 and 2, shown detached from the receptacle.
Figure 5:
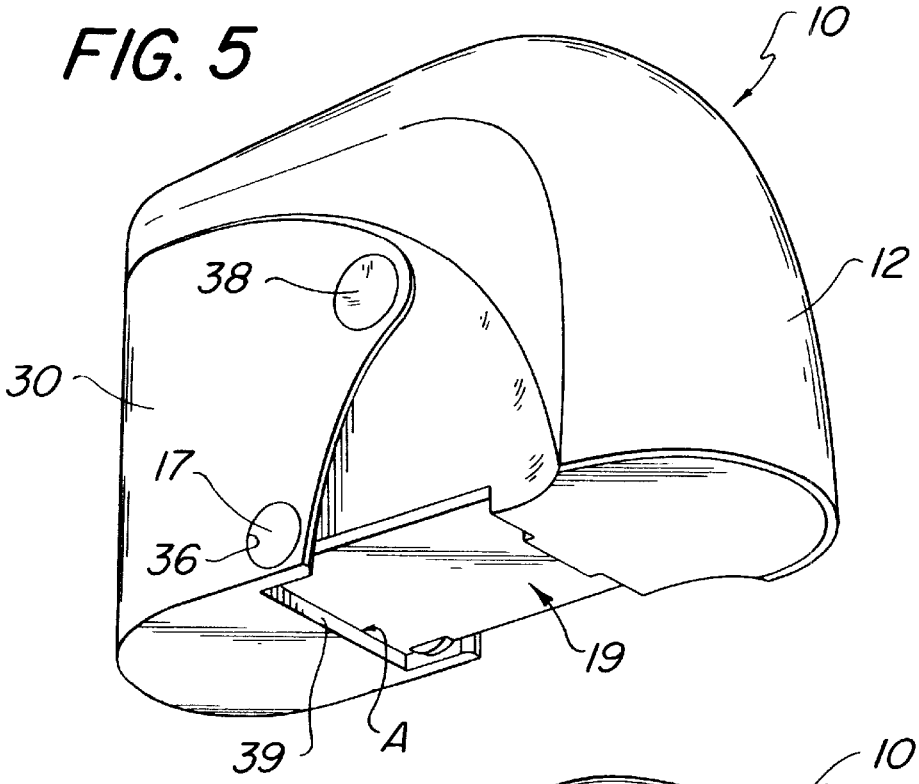
FIG. 5 is a perspective view of the pencil sharpener of FIG. 1 showing the receptacle in a closed position.

The receptacle 30 is contoured to cover and substantially close the cavity 14 when in the closed position. When closed, a lower surface 34 of the receptacle 30 fits closely with a bottom surface 19 of the housing 12, as shown in FIGS. 3 and 5. In this manner, the lower surface 34 and the bottom surface 19 form a storage seal, as shown at generally A in FIG. 5, sufficient for preventing spillage or leakage of the shavings while they are stored in the receptacle of the pencil sharpener. The receptacle 30 has a pair of sockets to provide hinged attachment of the receptacle 30 to the housing 12. Preferably, as shown in FIGS. 3 and 4, the sockets are through-openings 36 for receiving posts 17 mounted on the housing 12, each having a circular cross-section to facilitate pivoting of the receptacle 30 relative to the housing 12. Preferably, the receptacle 30 also includes a lip 35 contoured to fit closely and form an upper seal, as shown at B in FIG. 2, with an upper portion of the housing 12, e.g., at rim 15.

Figure 6:
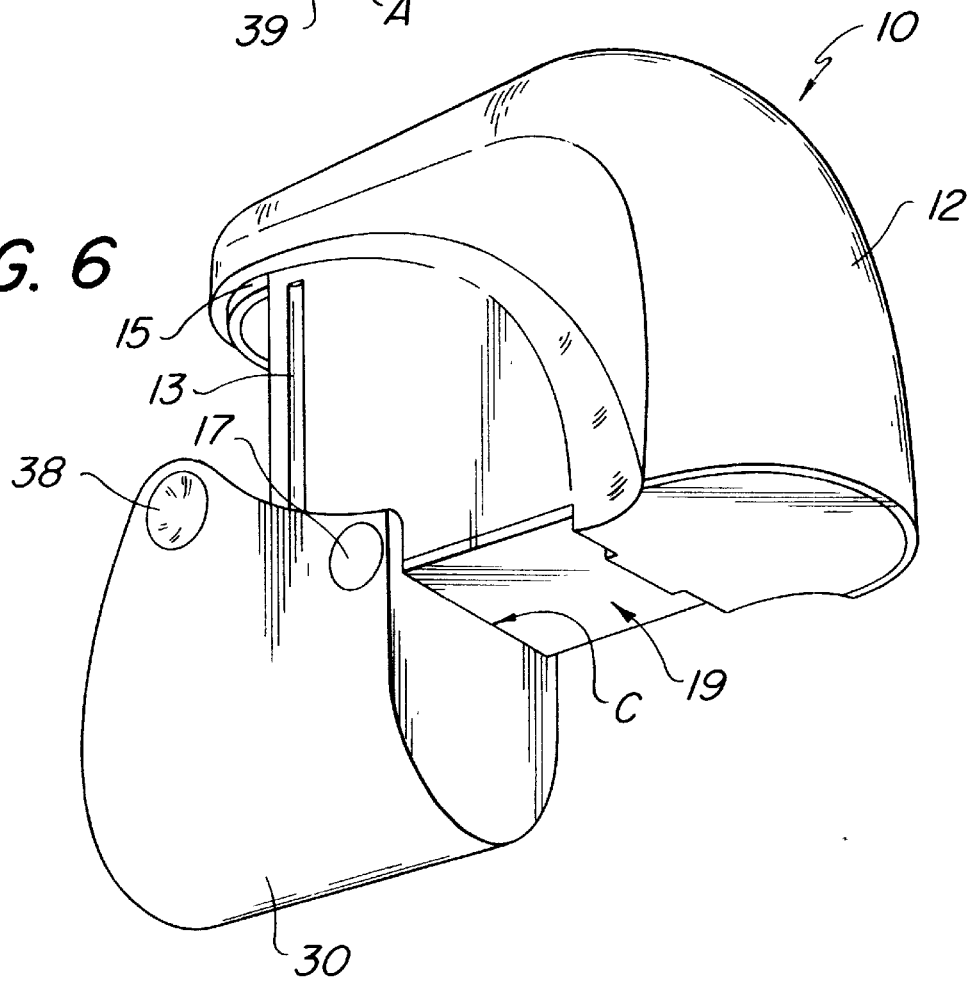
FIG. 6 is a perspective view of the pencil sharpener of FIG. 1 showing the receptacle in an open position.

Additionally, the receptacle 30 has a rearward edge 39 positioned to fit closely with the bottom surface 19 of the housing 12 when the receptacle 30 is in the fully-extended, open position, as shown in FIGS. 1, 5, and 6. In this manner, the rearward edge acts as a stop to limit rotation of the receptacle 30 when the rearward edge 39 contacts the bottom surface 19. Additionally, the rearward edge 39 and bottom surface 19 form a pouring seal, as shown generally at C in FIG. 6, for preventing spillage or leakage of shavings when pouring the shavings out of the receptacle to empty the pencil sharpener. For example, the open position may be separated from the closed position by a ninety (90) degree angular rotation of the receptacle 30. Furthermore, the receptacle 30 has a pair of elongated sidewalls 30*a*, 30*b* configured to flank at least a portion (as shown generally at X in FIG. 1) of the cavity 14 when the receptacle 30 is in the open position.

In the preferred embodiment, the housing 12 and receptacle 30 have mating ribs and grooves on opposing sides of the cavity 14. For example, as shown in FIGS. 1–2, a pair of vertical grooves 13 are formed on the housing 12, and a pair of ribs 33 are formed on the receptacle 30. The ribs 33 and grooves 13 are dimensioned and positioned to interfit when the receptacle 30 is in the closed position to positively retain the receptacle 30. Additionally, the ribs 33 and grooves 13 form major seals (at mating ribs and grooves shown in FIG. 1) for trapping shavings within the cavity and/or receptacle.

In a highly preferred embodiment, the receptacle 30 includes an interlock trigger 50 as shown in FIG. 3. The interlock trigger has an outwardly extending protrusion 52 for engaging an interlock switch mounted in the cavity 14 of the housing 12 when the receptacle 30 is in the closed position. The interlock switch is configured to engage the protrusion 52 only when the receptacle 30 is in the closed position. The interlock switch is configured to permit operation of the cutting assembly of the pencil sharpener only when the switch is engaged by the protrusion 52. This prevents injuries to the user resulting from contact with an operating cutting assembly.

Optionally, the housing 12 may include opposed finger grips 38 to identify proper placement of a user's fingers for opening and closing of the receptacle. For example, such finger grips may includes a pair of depressions 38, as shown in FIGS. 2 and 3. Alternatively the finger grips may include sets of bumps of ridges.

A user may operate the pencil sharpener 10 as follows. If necessary, the receptacle 30 is first placed in the closed position to close the cavity 14. The cavity 14 and receptacle 30 are thereby sealed by the storage (at A in FIG. 5), upper (at B in FIG. 2), and the major (at mating ribs and grooves shown in FIG. 1) seals to prevent leakage of any shavings. In an embodiment including an interlock trigger 52 and an interlock switch, the switch is engaged and the cutting assembly is permitted to operate. An unsharpened pencil is then inserted into the pencil-receiving opening 18 on the top 20 of the pencil sharpener 10. Sharpening the pencil, e.g., by inserting a pencil into a powered pencil sharpener, causes shavings to enter and be retained in the cavity 14 and the receptacle 30. Numerous pencils may be sharpened before emptying the shavings.

To empty the shavings from the pencil sharpener 10, a user holds the pencil sharpener and rotates the receptacle 30 into the open position, e.g, by grasping the receptacle with the thumb and forefinger resting in the finger grips 38 of the receptacle 30 and rotating the receptacle 30 about the posts 17. This causes the interlock trigger 52 to disengage the interlock switch and prevent the cutting assembly from operating. In the embodiment shown in FIGS. 1–6, this requires an angular rotation of approximately ninety (90) degrees. Rotation stops when the rearward edge 39 of the receptacle 30 rests against the bottom surface 19 of the housing 12, as shown in FIG. 6.

Controlled disposal of pencil shavings is achieved by using the receptacle 30 as a spout to pour a controlled flow of shavings from the receptacle 30 and cavity 40 to an appropriate refuse container. The rearward edge 39 of the receptacle 30 forms a pouring seal (at C in FIG. 6) with the bottom surface 19 of the housing 12 to prevent spillage of shavings.

Once the shavings have been emptied from the pencil sharpener, the receptacle 30 is restored to the closed position by rotating the receptacle until the ribs 33 of the receptacle 30 snap into and interfit with the grooves 13 of the housing 12.

Having thus described particular embodiments of the invention, various alterations, modifications, and improvements will readily occur to those skilled in the art. For example, it should be understood that the housing may be used for office products other than a pencil sharpener, e.g., a stapler, hole punch, binding machine, paper shredder, etc. The hinged receptacle in such products may be useful for storage, e.g, for storage of staples inside a stapler.

Additionally, the receptacle and housing may have various configurations. For example, the sockets may be depressions in the cover that fit with and receive bosses on the housing 12. The receptacle may open vertically or horizontally. For example, FIG. 1 shows a receptacle pivoting in a vertical plane from a side of the housing and FIGS. 7*a*–7*c* show a receptacle pivoting in a vertical plane from a bottom of the housing. FIGS. 8*a*–8*c* show a receptacle pivoting in a horizontal plane. For example, FIG. 8*b* shows a receptacle open at a top end. FIG. 8*c* shows a receptacle open at a lower end. In alternate embodiments, the ribs may be formed on the housing and the grooves may be formed on the receptacle.

Additionally, it should be appreciated that the integral receptacle can be accomplished in various ways, including other hinged arrangements, opening generally vertically or horizontally, or sliding arrangements in which the receptacle and housing move relative to one another sufficiently to release the shavings, either with or without inversion of the housing, and yet remain attached to the housing to impart stability to the receptacle and reduce the likelihood of spillage of shavings.

Such alterations, modifications and improvements as are made obvious by this disclosure are intended to be part of this description though not expressly stated herein, and are intended to be within the spirit and scope of the invention.

Accordingly, the foregoing description is by way of example only, and not limiting. The invention is limited only as defined in the following claims and equivalents thereto.

What is claimed is:

1. An office product comprising:

a housing having a pair of sidewalls spaced from one another, an open end defined between said pair of sidewalls, and a bottom wall extending between said pair of spaced sidewalls and adjacent to said open end, each of said pair of spaced sidewalls having an elongated groove adjacent to said open end; and a receptacle operatively connected to said housing and pivotable between an open position and a closed position, said receptacle defining a pair of ribs positioned to be received in said grooves when said receptacle is in the closed position to positively retain said receptacle in the closed position and to form a seal between said receptacle and said housing along said pair of spaced sidewalls of said housing, said receptacle defining a lower surface configured to form a second seal with said bottom wall of said housing when said receptacle is in the closed position, said receptacle further defining a rearward edge positioned to abut said bottom wall of said housing when said receptacle is in the open position;

wherein said housing defines a pencil-receiving opening, said office product further comprising a sharpening assembly mounted within said housing and positioned to sharpen a pencil inserted into said pencil-receiving opening.

2. The office product of claim 1, wherein said receptacle further comprises an interlock trigger having an outwardly extending protrusion, and wherein said housing comprises an interlock switch mounted to said housing and positioned to engage the protrusion of said interlock trigger when said receptacle is in the closed position.

3. The office product of claim 1, wherein the receptacle has a pair of opposed finger grips to facilitate operation of the receptacle between the open and closed positions.

4. The office product of claim 3, wherein the pair of opposed finger grips comprises a pair of indentations in the receptacle.

5. A pencil sharpener comprising:

a housing having a pencil-receiving opening, a cavity, and an open end providing access to said cavity;

a sharpening assembly mounted on said housing and positioned to sharpen a pencil inserted into said pencil-receiving opening and to discharge pencil shavings into said cavity; and a receptacle operatively connected to said housing to be pivotable between an open position in which said cavity is exposed, and a closed position in which said cavity is closed by closing said open end, said receptacle having a pair of elongated sidewalls configured to flank at least a portion of said open end when in the open position;

wherein said housing has a pair of sidewalls spaced from one another, said cavity being defined between said pair of sidewalls, said housing further having a bottom wall extending between said pair of spaced sidewalls and adjacent to said cavity, each of said pair of spaced sidewalls having an elongated groove adjacent said cavity, and wherein said receptacle defines a pair of ribs positioned to be received in said grooves when said receptacle is in the closed position to positively retain said receptacle in the closed position and to form a seal between said receptacle and said housing along said pair of spaced sidewalls of said housing, said receptacle defining a lower surface configured to form a second seal with said bottom wall of said housing when said receptacle is in the closed position, said receptacle further defining a rearward edge positioned to abut said bottom wall of said housing when said receptacle is in the open position to form a third seal therewith.

6. The office product of claim 5, wherein said receptacle further comprises an interlock trigger having an outwardly extending protrusion and wherein said housing comprises an interlock switch mounted to said housing and positioned to engage the protrusion of said interlock trigger when said receptacle is in a closed position.

7. The pencil sharpener of claim 5, wherein said housing extends elongatedly in a vertical plane and said receptacle is pivotable out of the vertical plane.

8. The pencil sharpener of claim 5, wherein said housing extends elongatedly in a vertical plane and said receptacle is pivotable in the vertical plane.

9. The pencil sharpener of claim 5, wherein the receptacle has a pair of opposed finger grips to facilitate operation of the receptacle between the open and closed positions.

10. The pencil sharpener of claim 9, wherein the pair of opposed finger grips comprises a pair of indentations in the receptacle.

11. A pencil sharpener comprising:

a housing having a pencil-receiving opening, a cavity, and an open end providing access to said cavity;

a sharpening assembly mounted on said housing and positioned to sharpen a pencil inserted into said pencil-receiving opening and to discharge pencil shavings into said cavity; and a receptacle operatively connected to said housing to be pivotable between an open position in which said cavity is exposed, and a closed position in which said cavity is closed by closing said open end, said receptacle having a pair of elongated sidewalls configured to flank at least a portion of said open end when in the open position;

wherein said housing has a pair of sidewalls spaced from one another, said cavity being defined between said pair of sidewalls, said housing further having a bottom wall extending between said pair of spaced sidewalls and adjacent to said cavity, each of said pair of spaced sidewalls having an elongated rib adjacent said cavity, and wherein said receptacle defines a pair of grooves positioned to received said ribs when said receptacle is in the closed position to positively retain said receptacle in the closed position and to form a seal between said receptacle and said housing along said pair of spaced sidewalls of said housing, said receptacle defining a lower surface configured to form a second seal with said bottom wall of said housing when said receptacle is in the closed position, said receptacle further defining a rearward edge positioned to abut said bottom wall of said housing when said receptacle is in the open position to form a third seal therewith.

12. The pencil sharpener of claim 11, wherein said receptacle further comprises an interlock trigger having an outwardly extending protrusion and wherein said housing comprises an interlock switch mounted to said housing and positioned to engage the protrusion of said interlock trigger when said receptacle is in a closed position.

13. The pencil sharpener of claim 11, wherein the receptacle has a pair of opposed finger grips to facilitate operation of the receptacle between the open and closed positions.

14. The pencil sharpener of claim 13, wherein the pair of opposed finger grips comprises a pair of indentations in the receptacle.

15. A pencil sharpener comprising:

a housing having a top defining a pencil-receiving opening, a bottom wall, and a cavity between said top and said bottom wall;

a sharpening assembly mounted within said housing and positioned to sharpen a pencil inserted into said pencil-receiving opening;

a pair of posts projecting outwardly from said housing adjacent opposite sides of said cavity, said pair of posts having a circular cross-section and a common axis; and a receptacle having a pair of openings positioned to receive said pair of posts and to operatively connect said receptacle to said housing to be pivotable between an open position in which said cavity is exposed, and a closed position in which said cavity is closed, said receptacle further having a rearward edge positioned to abut said bottom wall of said housing when said receptacle is in the open position to form a third seal therewith, said rearward edge disengaging from said bottom wall as said receptacle is pivoted from said open position to said closed position.

16. The pencil sharpener of claim 15, wherein said housing defines a pair of grooves, each of said pair of grooves extending along an edge of said cavity and wherein said receptacle defines a pair of ribs positioned to be received in said grooves when said receptacle is in the closed position to positively retain said receptacle in the closed position and to form a second seal between said receptacle and said housing.

17. The pencil sharpener of claim 15, wherein said housing defines a pair of ribs, each of said pair of ribs extending along an edge of said cavity and wherein said receptacle defines a pair of grooves positioned to receive said ribs when said receptacle is in the closed position to positively retain said receptacle in the closed position and to form a second seal between said receptacle and said housing.

18. The pencil sharpener of claim 15, wherein said receptacle further comprises an interlock trigger having an outwardly extending protrusion and wherein said housing comprises an interlock switch mounted to said housing and positioned to engage the protrusion of said interlock trigger when said receptacle is in a closed position.

19. The pencil sharpener of claim 15, wherein the receptacle has a pair of opposed finger grips to facilitate operation of the receptacle between the open and closed positions.

20. The pencil sharpener of claim 19, wherein the pair of opposed finger grips comprises a pair of indentations in the receptacle.

* * * * *